US007096813B1

(12) United States Patent
Luck

(10) Patent No.: US 7,096,813 B1
(45) Date of Patent: Aug. 29, 2006

(54) TIE UP ACCESSORY FOR A WATER CRAFT

(76) Inventor: Bill Luck, 7108 Camp Bowie Blvd., Fort Worth, TX (US) 76116

( * ) Notice: Subject to any disclaimer, the term of this patent is extended or adjusted under 35 U.S.C. 154(b) by 0 days.

(21) Appl. No.: 11/205,933

(22) Filed: Aug. 17, 2005

(51) Int. Cl.
*B63B 21/00* (2006.01)

(52) U.S. Cl. ..... 114/230.23; 114/230.24

(58) Field of Classification Search ..... 114/230.1, 114/230.23, 230.24; 242/381.5, 381.6, 384.7, 242/385.4
See application file for complete search history.

(56) References Cited

U.S. PATENT DOCUMENTS 1,811,400 A 6/1931 McClellan
3,012,736 A * 12/1961 Brust ..... 242/375.1
3,851,613 A 12/1974 Armour ..... 114/230
4,697,637 A 10/1987 Young ..... 114/230
4,846,090 A 7/1989 Palmquist ..... 114/230
4,969,610 A 11/1990 Taylor et al. ..... 242/86.5
5,819,679 A 10/1998 Bonate et al. ..... 114/230
6,095,075 A 8/2000 Gordon et al. ..... 114/230.25

* cited by examiner

*Primary Examiner*—Lars A. Olson
(74) *Attorney, Agent, or Firm*—Charles D. Gunter, Jr.

(57) ABSTRACT

A mooring device for a water craft capable of storing and dispensing a line used to moor a boat or the like is disclosed. A spring biased reel assembly carrying a mooring line is rotatably mounted on a surface of the craft. The reel assembly is urged by the spring toward a line take-up direction. The free end of the line passes through a lock assembly mounted on the water craft housing. In one position, the lock assembly selectively inhibits travel of the line and hence rotation of the reel assembly so that the paid-out line remains of a fixed length. In another position, the line travels freely and can be taken up by the spring action of the reel assembly.

14 Claims, 2 Drawing Sheets

TIE UP ACCESSORY FOR A WATER CRAFT

BACKGROUND OF THE INVENTION

1. Field of the Invention

The present invention relates generally to water craft mooring or tethering devices and, more specifically, to such a device which is capable of storing and dispensing variable lengths of mooring line and which provides positive locking of the line so as to maintain a water craft in a fixed position relative to another object such as a dock, pier, or another vessel.

2. Description of the Prior Art

Typically a boat or other water craft is secured in a stationary position by tying the frame of the craft to a fixed mooring facility such as a dock or pier with a rope or other type mooring line. The craft must be equipped with a sufficient length of line to enable it to be secured under a variety of mooring conditions. Such factors as the proximity and dimensions of the mooring facility will determine the length of line required to secure the craft in a given situation. The length of the mooring line must be adjustable based upon the requirements imposed by a wide variety of mooring conditions. Rope or line which is not being used to secure the craft should be stowed on board the water craft in a neat and orderly fashion. A mooring line which is kept coiled or loosely stored in the bottom of the craft may become knotted and/or entangled with passengers, cargo and other equipment on board the craft.

In recent years, the so-called "personal water crafts" such as the Sea-Doo® manufactured by Bombardier, Inc., and the Waverunner® manufactured by Yamaha, Inc. have become increasingly popular. These power craft provide some of the feel or experience of both motor powered water craft and skis. A number of these craft are intended to be operated by a single user with perhaps one passenger. As a result, storage space is severely limited. Because of the small, compact nature of these craft and the general lack of available storage space, these craft have not, in the past, generally been equipped with any satisfactory tie down or mooring accessory. While larger boats might be able to accommodate a variety of relatively complicated winches and take up reels or on-deck cleats, the personal water craft of the above type continues to have a need for a small, relatively uncomplicated and compact tie down accessory.

A need exists, therefore, for a device which can be affixed to a water craft, including a personal water craft of the Sea-Doo® variety, which is capable of storing a sufficient quantity of mooring line and dispensing the line in variable lengths.

A need also exists for such a mechanism which can be affixed to a personal water craft which is capable of reliably and repeatably extending and retracting a tethering line while simultaneously providing positive locking of the tether once a desired length of line has been payed out.

SUMMARY OF THE INVENTION

The mooring device constructed in accordance with the present invention provides a convenient, compact and effective means of storing and dispensing line used to secure a water craft in a desired location. The device includes a spring loaded payoff reel mounted on a planar surface of the water craft for dispensing a mooring line. A line passage hole is provided in the planar surface of the water craft adjacent the payoff reel for receiving the mooring line. A locking mechanism comprising a pair of inner and outer nested cylinders is mounted within the line passage hole, each of the nested cylinders having a rear cylinder sidewall provided with a line passage aperture through which a free end of the mooring line passes. The inner nested cylinder is rotatably mounted relative to the outer nested cylinder. The inner nested cylinder is movable between an unlocked position in which the rear cylinder wall apertures are aligned and the mooring line freely travels to allow the mooring line to freely unwind from the payoff reel and a locked position in which the apertures are misaligned and the mooring line is clinched between the rear cylinder sidewalls. When the device is mounted within the line passage hole in the planar surface of the water craft, an exposed end of the inner nested cylinder is exposed for manual actuation and the mooring line is exposed for extension to a mooring structure. Preferably, the manual actuation of the exposed end of the inner nested cylinder is accomplished by a user grasping and rotating the inner cylinder relative to the outer cylinder In a particularly preferred form of the invention, the outer nested cylinder has a mounting flange integrally fixed on an outer cylindrical sidewall thereof, the mounting flange being provided with a plurality of fastener openings. The mounting flange is received on the inner planar surface of the water craft peripheral to the line passage hole. A mating keeper plate is mounted on an outer planar surface of the water craft peripheral to the line passage hole. The keeper plate also has a plurality of fastener openings which are alignable with the openings on the mounting flange for receiving mating fasteners. For providing the movement between the unlocked and locked positions the outer nested cylinder is provided with a cam opening and the inner nested cylinder is provided with a mating cam, whereby the cam travels in the cam opening as the inner nested cylinder is rotated to move the locking mechanism between the unlocked and locked positions. In a preferred embodiment of the invention, the cam extends perpendicular to the outer cylindrical sidewall of the inner nested cylinder and the cam opening provided in the outer nested cylinder is an elongate slot.

A method of mooring a water craft is also shown in which the previously described tie up device is mounted on a water craft and line is payed out through the aligned apertures of the rear cylinder sidewalls of the nested cylinders. Once the desired length of line has been fed out, a user rotates the inner nested cylinder relative to the outer cylinder so that the cylinder apertures are misaligned and the mooring line is clinched between the rear cylinder sidewalls to thereby rotationally lock a given length of paid out line. The operation is reversed by simply rotating the inner nested cylinder in the opposite direction to again allow free travel of the line through the now aligned cylinder apertures so that the spring action of the payout reel is allowed to retrieve the paid out line onto the reel.

Additional objects, features and advantages will be apparent in the written description which follows.

DETAILED DESCRIPTION OF THE INVENTION

Figure 1:
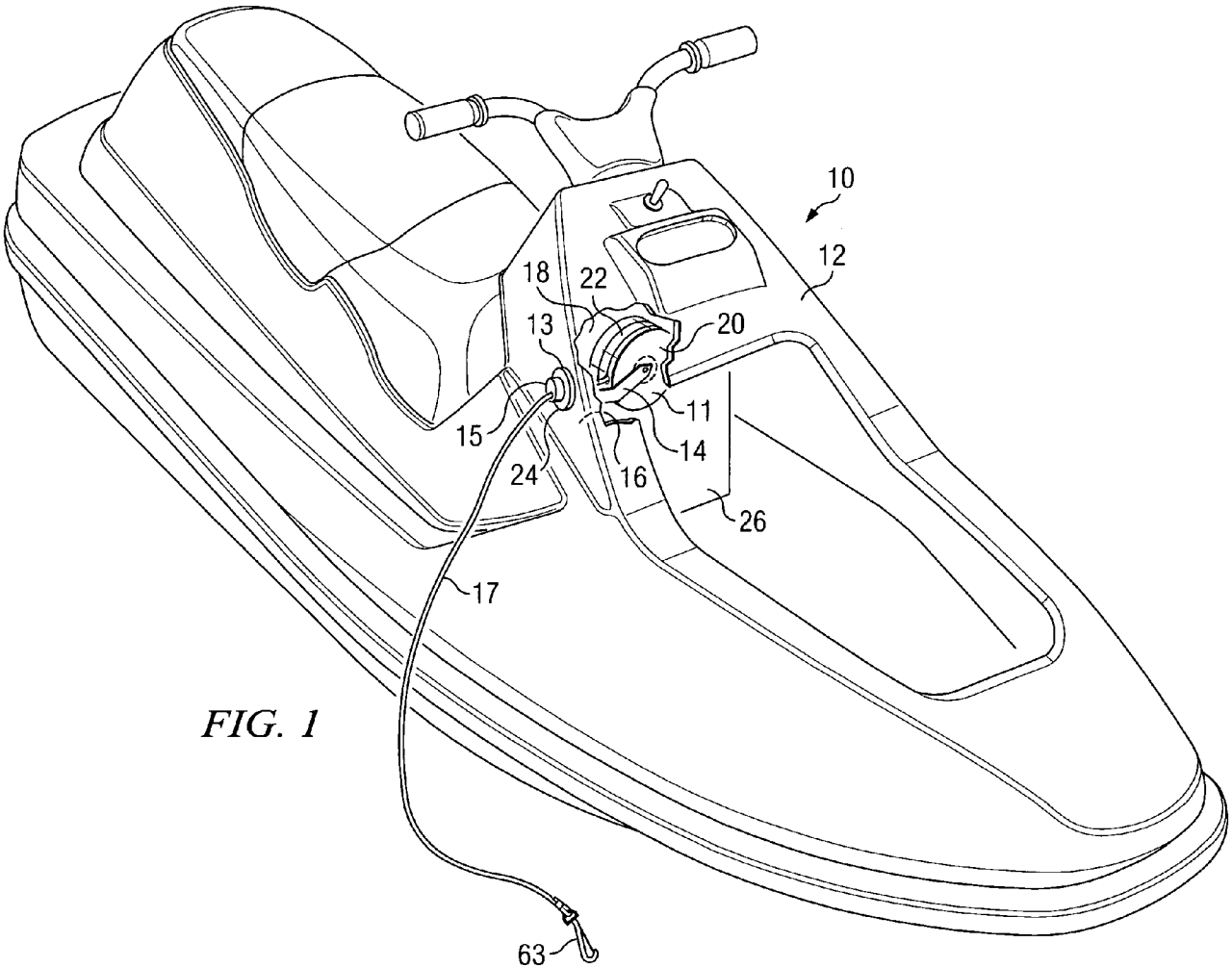
FIG. 1 is a perspective view of a water craft which is equipped with the tie up accessory of the invention, a portion of the planar sidewall of the water craft being shown broken away in order to reveal the spring loaded payout reel.

FIG. 1 shows a water craft 10 of the type intended to be fitted with the tie-up accessory of the present invention. It will be appreciated in the discussion which follows that the tie-up accessory of the invention could be utilized with a variety of different type water craft and boats and, in fact, could even be mounted on the mooring itself rather than on the craft. However, the invention has particular application to the "personal water craft" of the type illustrated as 10 in FIG. 1. As mentioned briefly in the background discussion of the invention, these type craft are sold commercially as the Sea-Doo® by Bombardier, Inc., the Waverunner® by Yamaha, Inc. Other commercially available craft are manufactured by Kawasaki, Inc. and Polaris, Inc. The present invention has particular applicability to personal water craft of the type shown because of the lightweight and maneuverable nature of the craft and due to the fact that only a limited amount of storage space is typically available on the craft. Also, personal water craft of the type illustrated in FIG. 1 have not typically been provided with a convenient tethering or tie-up mechanism in the past.

As shown in FIG. 1, the tie-up accessory of the invention includes, as one component thereof, a spring-loaded payoff reel 11 which is mounted on a convenient planar surface of the water craft for dispensing a mooring line 17. Although the payoff reel could be mounted in a variety of locations, it is preferably mounted on an inside planar surface (16 in FIGS. 1 and 2) of the console 12. In the embodiment of the device illustrated in FIG. 1, the reel 11 is mounted by means of spaced apart side arms 14 on the inside planar surface 16. The side arms 14 could also be attached in other ways. For example, the side arms could be attached to a convenient surface of the locking mechanism (to be described) of the tie-up accessory.

The payoff reel 11, as shown in FIG. 1, has opposing guide walls 18, 20 and a centrally located spool (shown in dotted lines as 22 in FIG. 1) for retaining the mooring line on the reel and for extending and retracting the mooring line. The console 12, as shown in FIG. 1, is equipped with a line passage hole (approximately at 24 in FIG. 1) which is located in the planar surface 16 of the water craft 10 adjacent the payoff reel 11. While the reel 11 could be mounted, for example, on the bulkhead 26, it is most conveniently mounted adjacent and spanning the line passage hole 24. As can be seen in FIG. 1, the mounting arms 14 mount the reel 11 such that the spool rotates in a plane, substantially perpendicular to the planar surface 16 of the water craft. The payoff reel 11 is spring biased to rotate in a take-up direction for retracting the mooring line 17.

Figure 2:
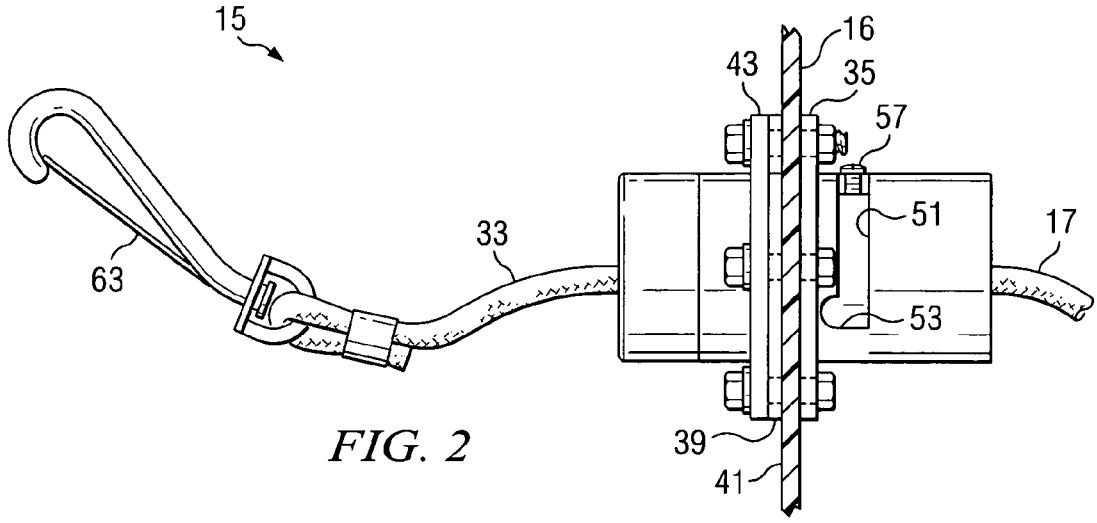
FIG. 2 is an isolated, side view of the locking mechanism of the device of the invention showing a portion of the mooring line being paid out through the aligned openings of the nested cylinders.
Figure 3A:
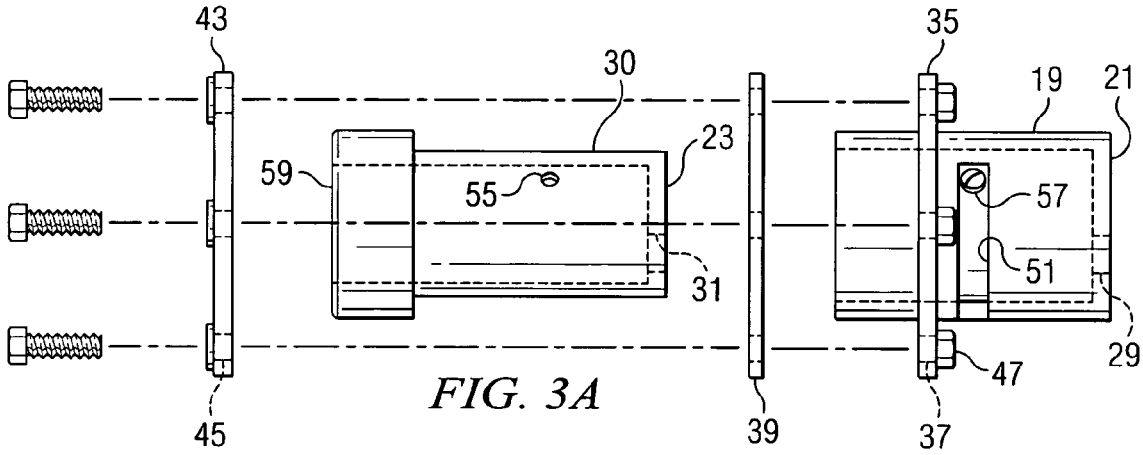
FIG. 3A is an exploded view of the locking mechanism of the device of the invention showing the mounting components thereof.

As shown in FIGS. 2 and 3A, a locking mechanism is provided for controlling the payout and retraction of the mooring line 17. The locking mechanism 15 includes a pair of inner and outer nested cylinders (19, 30 in FIG. 3A) which are mounted within the line passage hole (24 in FIG. 1). The line passage hole can be formed in any convenient fashion, for example, by drilling or cutting through the planar surface of the water craft. Each of the nested cylinders 19, 30 has generally cylindrical sidewall portion and a rear sidewall 21, 23, respectively. The rear sidewalls 21, 23 are each provided with line passage aperture 29, 31, respectively, through which a free end (33 in FIG. 2) of the mooring lines 17 passes. As will be described in greater detail below, the inner cylinder 30 is rotatably mounted relative to the outer nested cylinder 19.

As best seen in FIG. 3A, the outer nested cylinder 19 has a circumferential mounting flange 35 integrally molded or fixed on the outer cylindrical sidewall thereof and provided with a plurality of fastener openings 37. The mounting flange 35 is received on the inner planar surface (16 in FIG. 2) of the water craft peripheral to the line passage hole 24. A sealing gasket 39 is preferably received on an outer planar surface 41 of the water craft in order to provide a water tight seal for the locking mechanism. A mating keeper plate 43 is mounted on the outer planar surface 41 of the water craft peripheral to the line passage hole 24. The keeper plate 43 also has a plurality of fastener openings (45 in FIG. 3A) which are alignable with the openings 37 on the mounting flange 35 for receiving mating fasteners. In the embodiment of the device shown in FIG. 3A, the fasteners are a plurality of nuts 47 and threaded bolts 49.

As shown in FIGS. 2 and 3A, the outer nested cylinder 19 is provided with a cam opening in the form of a longitudinal slot 51 having a bottom foot region 53. The inner nested cylinder 30 has a mounting opening (55 in FIG. 3A) into which is fitted a vertically extending cam 57 (FIG. 2). The cam 57 travels in the cam opening 51 as the inner nested cylinder 30 is rotated to move the locking mechanism between unlocked and locked positions. The cam 57 extends perpendicular to the outer cylindrical sidewall of the inner nested cylinder.

The installation and operation of the device of the invention is as follows. As shown in FIG. 2 and described above, the inner and outer nested cylinders are installed on the planar surface of the craft by means of the mounting flange 35 and keeper plate 43. After drilling a suitable line passage hole, the inner nested cylinder 30 is installed with the interior of the outer nested cylinder 19 with the exposed end 59 being exposed for manual actuation by a user. The cam 57 is installed within the mounting opening 55 so that the inner cylinder can be rotated relative to the outer cylinder but longitudinal movement is restricted. The mooring line 17 is fed through the aligned openings (opening 31 visible in FIG. 3B) so that the free end 33 exits the locking mechanism on the exterior of the planar mounting surface. In the example shown in FIG. 2, an accessory clip 63 is attached to the free end 33 of the mooring line 17.

Figure 3B:
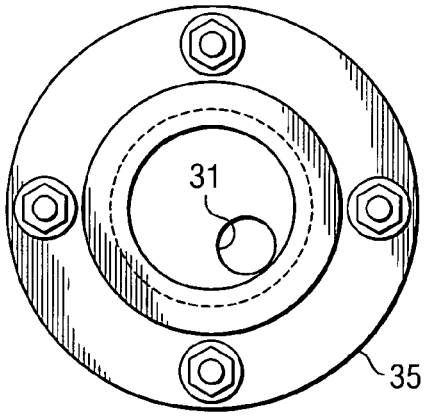
FIG. 3B is a rear view of the locking mechanism showing the cylinder apertures in the unlocked position.
Figure 3C:
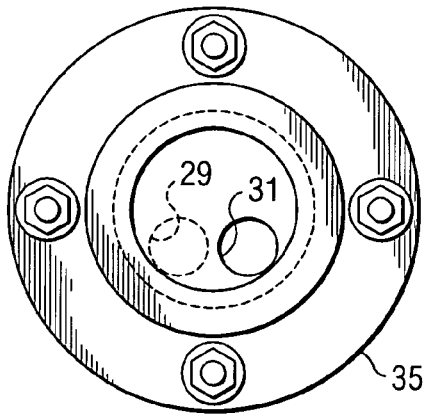
FIG. 3C is also a rear view of the locking mechanism of the invention but showing the cylinder apertures in the locked position with the mooring line removed for ease of illustration.

As illustrated in FIGS. 3B and 3C, the inner nested cylinder 19 is movable between an unlocked position in which the rear cylinder apertures (31 illustrated in FIG. 3B) are aligned and the mooring line freely travels to allow the mooring line to freely unwind from the payoff reel and a locked position in which the apertures are misaligned (shown at 29 and 31 in FIG. 3C) and the mooring line is clinched between the rear cylinder sidewalls 21, 23 to thereby rotationally lock a given length of paid-out line. The manual actuation of the exposed end 59 of the inner nested cylinder 30 is easily accomplished by a user grasping and rotating the inner cylinder 30 relative to the outer cylinder 19.

When the line passage apertures 29, 31 are aligned as shown in FIG. 3B, a user can easily pull the mooring line 17 through the line passage hole 24 provided in the water craft sidewall so that the accessory clip 63 can be used to moor the device to a dock or other object. Once the desired length of line has been paid out, the user rotates the exposed end 59 of the inner cylinder 30 in order to bind or pinch the mooring line 17 between the respective line passage apertures 29, 31 of the locking mechanism. This action secures a fixed length of paid out line and resists the spring tension exerted on the line by means of the payoff reel 11. Once the exposed end 59 is rotated in the opposite direction so that the line passage apertures are once again aligned, the mooring lines 17 is retracted and would back upon the spool of the payout reel 11 by means of the spring tension exerted upon the spool.

An invention has been provided with several advantages. The tie-up accessory of the invention is simple in design and economical to manufacture. The payoff reel of the device can be located on an interior surface of a console so that it does not detract from the esthetic appearance of the craft. The locking mechanism requires only that a single hole be drilled or cut through the craft sidewall at a single location plus small holes for the mounting fasteners. The simple rotational locking action of the nested cylinders provides a simple yet effective means for fixing a given length of paid out line against the spring tension of the take up reel. The device is ideally suited for use with a personal water craft since such crafts tend to be lighter and smaller than traditional boats, thereby allowing a simpler and lighter weight locking mechanism to be utilized.

While the invention has been shown in only one of its forms, it is not thus limited but is susceptible to various changes and modifications without departing from the spirit thereof.

What is claimed is:

1. A tie up accessory for mooring a water craft, comprising a spring loaded payoff reel mounted on a planar surface of the water craft for dispensing a mooring line;

a line passage hole located in the planar surface of the water craft adjacent the payoff reel for receiving the mooring line;

a locking mechanism comprising a pair of inner and outer nested cylinders mounted within the line passage hole, each of the nested cylinders having a rear cylinder sidewall provided with a line passage aperture through which a free end of the mooring line passes, and wherein the inner nested cylinder is rotatably mounted relative to the outer nested cylinder, the inner nested cylinder being movable between an unlocked position in which the rear cylinder wall apertures are aligned and the mooring line freely travels to allow the mooring line to freely unwind from the payoff reel and a locked position in which the apertures are misaligned and the mooring line is clinched between the rear cylinder sidewalls.

2. The tie up accessory of claim 1, wherein when the device is mounted to a surface of a water craft, an exposed end of the inner nested cylinder is exposed for manual actuation and the mooring line is exposed for extension to a mooring structure.

3. The tie up accessory of claim 2, wherein manual actuation of the exposed end of the inner nested cylinder is accomplished by a user grasping and rotating the inner cylinder relative to the outer cylinder.

4. The tie up accessory of claim 1, wherein the payoff reel is biased to rotate in a take-up direction for retracting the mooring line.

5. A tie up accessory for mooring a water craft, comprising a spring loaded payoff reel mounted on an inside planar surface of the water craft, the reel having opposed guide walls and a centrally located spool for retaining the mooring line on the reel, for extending and retracting the mooring line, the reel being mounted such that the spool rotates in a plane substantially perpendicular to the planar surface of the water craft;

a line passage hole located in the planar surface of the water craft adjacent the payoff reel;

a locking mechanism comprising a pair of inner and outer nested cylinders mounted within the line passage hole, each of the nested cylinders having a rear cylinder sidewall provided with a line passage aperture through which a free end of the mooring line passes, and wherein the inner nested cylinder is rotatably mounted relative to the outer nested cylinder, the inner nested cylinder being movable between an unlocked position in which the rear cylinder wall apertures are aligned and the mooring line freely travels to allow the mooring line to freely unwind from the payoff reel and a locked position in which the apertures are misaligned and the mooring line is clinched between the rear cylinder sidewalls to thereby rotationally lock a given length of paid out line.

6. The tie up accessory of claim 5, wherein when the device is mounted to a surface of a water craft, an exposed end of the inner nested cylinder is exposed for manual actuation and the mooring line is exposed for extension to a mooring structure.

7. The tie up accessory of claim 6, wherein manual actuation of the exposed end of the inner nested cylinder is accomplished by a user grasping and rotating the inner cylinder relative to the outer cylinder.

8. The tie up accessory of claim 5, wherein the outer nested cylinder has a mounting flange integrally fixed on an outer cylindrical sidewall thereof and provided with a plurality of fastener openings, the mounting flange being received on the inner planar surface of the water craft peripheral to the line passage hole.

9. The tie up accessory of claim 8, wherein a mating keeper plate is mounted on an outer planar surface of the water craft peripheral to the line passage hole, the keeper plate also having a plurality of fastener openings which are alignable with the openings on the mounting flange for receiving mating fasteners.

10. The tie up accessory of claim 5, wherein the outer nested cylinder is provided with a cam opening and the inner nested cylinder is provided with a mating cam, and wherein the cam travels in the cam opening as the inner nested cylinder is rotated to move the locking mechanism between the unlocked and locked positions.

11. The tie up accessory of claim 10, wherein the cam extends perpendicular to the outer cylindrical sidewall of the inner nested cylinder and the cam opening provided in the outer nested cylinder is an elongate slot.

12. A method of mooring a water craft, the method comprising the steps of:

mounting a spring loaded payoff reel on an inside planar surface of the water craft, the reel having opposed guide walls and a centrally located spool for retaining the mooring line on the reel, for extending and retracting the mooring line, the reel being mounted such that the spool rotates in a plane substantially perpendicular to the planar surface of the water craft;

providing a line passage hole located in the planar surface of the water craft adjacent the payoff reel;

mounting a locking mechanism comprising a pair of inner and outer nested cylinders mounted within the line passage hole and passing a free end of the mooring line through the locking mechanism, each of the nested cylinders of the locking mechanism having a rear cylinder sidewall provided with a line passage aperture through which a free end of the mooring line passes, and wherein the inner nested cylinder is rotatably mounted relative to the outer nested cylinder, the inner nested cylinder being movable between an unlocked position in which the rear cylinder wall apertures are aligned and the mooring line freely travels to allow the mooring line to freely unwind from the payoff reel and a locked position in which the apertures are misaligned and the mooring line is clinched between the rear cylinder sidewalls to thereby rotationally lock a given length of paid out line;

pulling the free end of the mooring line to pay out a given amount of line from the payoff reel; and rotating the inner nested cylinder to move the locking mechanism from the unlocked position to the locked position to secure a given amount of mooring line in a paid out position.

13. The method of claim 12, wherein when the device is mounted to a surface of a water craft, an exposed end of the inner nested cylinder is exposed for manual actuation and the mooring line is exposed for extension to a mooring structure.

14. The method of claim 13, wherein manual actuation of the exposed end of the inner nested cylinder is accomplished by a user grasping and rotating the inner cylinder relative to the outer cylinder.

* * * * *